US009044654B2

(12) United States Patent
Mickle

(10) Patent No.: US 9,044,654 B2
(45) **Date of Patent: *Jun. 2, 2015**

(54) GOLF PUTTER

(71) Applicant: Wesley J Mickle, Weatherford, TX (US)

(72) Inventor: Wesley J Mickle, Weatherford, TX (US)

( * ) Notice: Subject to any disclaimer, the term of this patent is extended or adjusted under 35 U.S.C. 154(b) by 7 days.

This patent is subject to a terminal disclaimer.

(21) Appl. No.: 13/899,638

(22) Filed: May 22, 2013

(65) Prior Publication Data

US 2014/0171217 A1 Jun. 19, 2014

Related U.S. Application Data

(63) Continuation-in-part of application No. 29/442,133, filed on Dec. 14, 2012, now Pat. No. Des. 710,958.

(51) Int. Cl.

| | |
|---|---|
| ***A63B 69/36*** | (2006.01) |
| ***A63B 53/04*** | (2006.01) |
| *A63B 71/06* | (2006.01) |

(52) U.S. Cl.

CPC ..... *A63B 53/0487* (2013.01); *A63B 2071/0694* (2013.01); *A63B 2209/00* (2013.01); *A63B 2053/0408* (2013.01); *A63B 2053/0491* (2013.01); *A63B 2053/0441* (2013.01)

(58) Field of Classification Search

CPC ..... A63B 53/0487; A63B 2071/0694; A63B 2209/00; A63B 2053/0408; A63B 2053/0491; A63B 2053/0441

USPC ..... 473/251–255, 313, 314, 340, 341; D21/736–746

See application file for complete search history.

(56) References Cited

U.S. PATENT DOCUMENTS

| | | | | | |
|---|---|---|---|---|---|
| 1,454,267 | A | | 5/1923 | Challis et al. | |
| D123,880 | S | * | 12/1940 | Flowers | D21/746 |
| D149,156 | S | * | 3/1948 | Weatherington | D21/743 |
| 2,843,384 | A | | 7/1958 | Schmidt | |
| D185,522 | S | * | 6/1959 | Whitney | D21/741 |
| 3,043,596 | A | | 7/1962 | Ehmke | |
| D206,549 | S | | 12/1966 | Mackenzie | |
| 3,841,641 | A | * | 10/1974 | Bennett | 473/249 |
| 3,866,922 | A | | 2/1975 | Marci et al. | |
| 3,873,094 | A | | 3/1975 | Sebo et al. | |
| 3,888,484 | A | * | 6/1975 | Zitko | 473/252 |
| 4,222,566 | A | | 9/1980 | Berry | |
| 4,326,716 | A | | 4/1982 | LaCoste | |
| 4,369,974 | A | | 1/1983 | Komperda | |
| 4,749,196 | A | | 6/1988 | Podgor | |

(Continued)

*Primary Examiner* — Sebastiano Passaniti

(74) *Attorney, Agent, or Firm* — Decker Jones et al.; Brian K. Yost; Geoffrey A. Mantooth

(57) ABSTRACT

An improved putter comprising concentrations of mass near a heel and a toe and a wide profile is provided. The golf putter generally comprises a golf putter head comprising a face, an upper surface, a sole, a rear surface, and sides and a shaft. A heel-side comprises a heel-side forward scalloped portion and a toe-side comprises a toe-side forward scalloped portion. The heel-side and toe-side forward scalloped portions each extend upward from the sole. The heel-side further comprises a heel-side angular scalloped portion and the toe-side further comprises a toe-side angular scalloped portion. The heel-side angular scalloped portion extends at an angle from the rear surface towards a forward heel corner, said the toe-side angular scalloped portion extends at an angle from the rear surface towards a forward toe corner. A rear surface comprises a central scalloped portion. The head may be transparent and comprise a sight member.

16 Claims, 6 Drawing Sheets

(56) References Cited

U.S. PATENT DOCUMENTS

| | | | | | |
|---|---|---|---|---|---|
| 5,082,277 | A | | 1/1992 | Gingold | |
| D324,556 | S | * | 3/1992 | Guerin, Sr. | D21/741 |
| D325,414 | S | | 4/1992 | Woolsey | |
| 5,226,654 | A | | 7/1993 | Solheim | |
| 5,467,989 | A | | 11/1995 | Good et al. | |
| 5,685,784 | A | * | 11/1997 | Butler | 473/340 |
| D403,387 | S | | 12/1998 | Bloomer | |
| 5,964,669 | A | | 10/1999 | Bloomer | |
| 6,217,459 | B1 | * | 4/2001 | Purcell | 473/313 |
| RE37,519 | E | | 1/2002 | Densberger et al. | |
| D458,657 | S | | 6/2002 | Shmoldas et al. | |
| D484,935 | S | | 1/2004 | Tang | |
| D486,540 | S | * | 2/2004 | Bettinardi | D21/738 |
| D496,972 | S | * | 10/2004 | Higbee | D21/736 |
| 7,169,058 | B1 | | 1/2007 | Fagan | |
| 8,608,588 | B2 | * | 12/2013 | Horii | 473/334 |
| D705,369 | S | * | 5/2014 | Mickle | D21/736 |
| D707,314 | S | * | 6/2014 | Mickle | D21/736 |
| D710,958 | S | * | 8/2014 | Mickle | D21/736 |
| D710,959 | S | * | 8/2014 | Mickle | D21/736 |
| 2005/0192114 | A1 | * | 9/2005 | Zider et al. | 473/251 |
| 2007/0254748 | A1 | * | 11/2007 | Stellander | 473/340 |
| 2009/0017934 | A1 | * | 1/2009 | Stites et al. | 473/290 |
| 2012/0064992 | A1 | * | 3/2012 | Franklin | 473/340 |

* cited by examiner

GOLF PUTTER

FIELD OF THE INVENTION

The present invention relates generally to a golf club and specifically to an improved golf putter.

BACKGROUND OF THE INVENTION AND DESCRIPTION OF THE PRIOR ART

While delight, contentment, and enjoyment may result from the feel and sight of a golf ball honing in on a flagstick after a well-executed golf stroke, a like amount of frustration and disappointment invariably results from the cold vibration and wayward path of the poorly struck golf ball. Such is the game of golf—a game played for centuries throughout the world. Presently, as many as 60 million people play golf across the globe on over 32,000 golf courses. The United States alone accounts for over half these numbers. With all of golfs popularity, it is the rare person indeed who does not encounter frustration while playing the game. In an effort to eliminate, or at least minimize, frustration, the golfer seeks refuge in golf books, magazines, videos, private instruction, hours of practice, and improved equipment.

Each aspect of the game presents challenges. For example, in driving the ball from a tee, the club head may reach a speed in excess of 100 miles per hour. Consistently coordinating this explosion of energy with sufficient accuracy is exceedingly difficult for even the professional golfer. In most cases, the weekend golfer lacks the physical ability to match the distance and accuracy of the professional.

Similarly, approach shots to the green often require a great deal of arc and backspin in order for the ball to land close to the hole or even remain on the green. Because weekend golfers often drive the ball a shorter distance, they must use a less lofted club on approach shots in order to reach the green, resulting in less accuracy and more frustration. Thus, the gap widens between the weekend golfers' golf games and those of their professional counterparts.

Putting, on the other hand, does not demand explosive energy, high club head speed, or a great deal of manual dexterity. Rather, putting requires proper equipment, technique, alignment, and concentration. With the right equipment and practice, accurate putting, more than any other shot in golf, may be mastered by almost all that play the game. And because putting may account for almost half the number of total strokes in a round of golf, it is this area of golf in which high handicap golfers and professional golfers alike may improve their golf games.

Just as in other golf strokes, the putting stroke involves a take-away, a forward stroke, and a follow-through. The face angle and path of the putter at the point of impact is important for determining a putt's accuracy. Generally, a face that is perpendicular to the target line at the point of impact is more accurate than one that is not. A swing path that approximates the direction of the target line also promotes putting accuracy. While a number of golf putters and golf putting methods are known in the art, there is a need for an improved golf putter which will permit a golfer to square the face at impact and move the putter along a path more closely related to the target line.

The present disclosure provides an improved golf putter comprising concentrations of mass near a heel and a toe and a wide profile.

SUMMARY OF THE INVENTION

The present disclosure provides an improved putter head comprising concentrations of mass near a heel and a toe and a wide profile. The golf putter generally comprises a golf putter head and a shaft. The shaft comprises a conventional and commercially available grip mounted on its upper end.

The golf putter head generally comprises a face, a toe, and a heel. The golf putter head further comprises upper, sole, rear, and side surfaces, the side surfaces comprising a heel-side surface and a toe-side surface. In the approximate center of the putter head and extending from the rear surface towards the face, the putter head further comprises a sight member. In use, the sight member is centered on the imaginary line bisecting the sweet spot and the center of gravity. Ideally, the user should position the putter with the sight member aligned with the target line. Thus, the horizontal arrangement of the sight member offers the user a visual reference for the preferred area on the face to contact the ball as well as a visual reference for the target line. The sight member of the preferred embodiment comprises a cylindrical length of material. As the putter head of the preferred embodiment is formed from methyl methacrylate and is transparent, the sight member can easily be visualized by the user. In the preferred embodiment, the sight member is of a contrasting color to the color of the putter head. In one embodiment, the sight member is white. In another embodiment, the sight member is red. However, the sight member can be virtually any color that can be easily visualized. The sight member color may also be such that the particular model or type of putter.

The toe and heel portions comprise rounded portions along the edges at which the face and rear surfaces meet the respective side surfaces. In other embodiments, the edges may comprise an orthogonal arrangement such that the respective surfaces meet at sharp right angles. Alternatively, the toe and heel portions may comprise angled or beveled portions along the edges at which the face and rear surface meet the respective side surfaces.

Each side surface comprises a forward scalloped portion extending upward from the sole surface. Each forward scalloped portion is vertically arranged such that it extends upward from the sole to a position intersected by respective angular scalloped portions. A forward edge of each forward scalloped portion is set back from the club face. A rearward edge is set back from the club face approximately.

Each side surface further comprises the angular scalloped portions which intersect the forward scalloped portions. The angular scalloped portions extend at an angle from the rear surface towards the corresponding toe and heel. As the angular portions angle away from the rear surface towards the respective toe and heel, the angular scalloped portions are wider near the rear surface than proximate to the face.

The rear face comprises a central scalloped portion extending upward from the sole surface to the upper surface. The central scalloped portion is vertically arranged such that it extends upward from the sole to the upper surface. A heel-side edge of the central scalloped portion is set inward from the heel-side. A toe-side edge of the central scalloped portion is set inward from the toe-side.

In the preferred embodiment, the lower edge, at which the face and sole meet, is beveled. In the preferred embodiment, the bevel extends at approximately a 45° from both surfaces.

The portions of the rear surface on either side of the central scalloped portion are beveled at a position at which such rear surface portions meet the sole. In preferred embodiments, the bevels extend at approximately a 45° from both surfaces.

The upper surface further comprises a canal adapted for insertion of the shaft. The position of the canal may vary depending on the particular embodiment. In preferred embodiments, the canal is positioned away from the sight member towards the heel-side of the putter head and away from the face.

A lower end of the putter shaft is positioned and affixed within the canal. In different embodiments, the shaft may comprise different configurations. In one embodiment, the shaft, vertically positioned within the canal, bends at an angle towards and beyond the heel-side. In another embodiment, the shaft comprises a complex bending arrangement such that the shaft, vertically positioned within the canal, beginning at the upper surface, bends forward and towards the heel-side, and at a position above the upper surface, bends at an angle towards and beyond the heel-side.

DESCRIPTION OF THE PREFERRED EMBODIMENT

Figure 1:
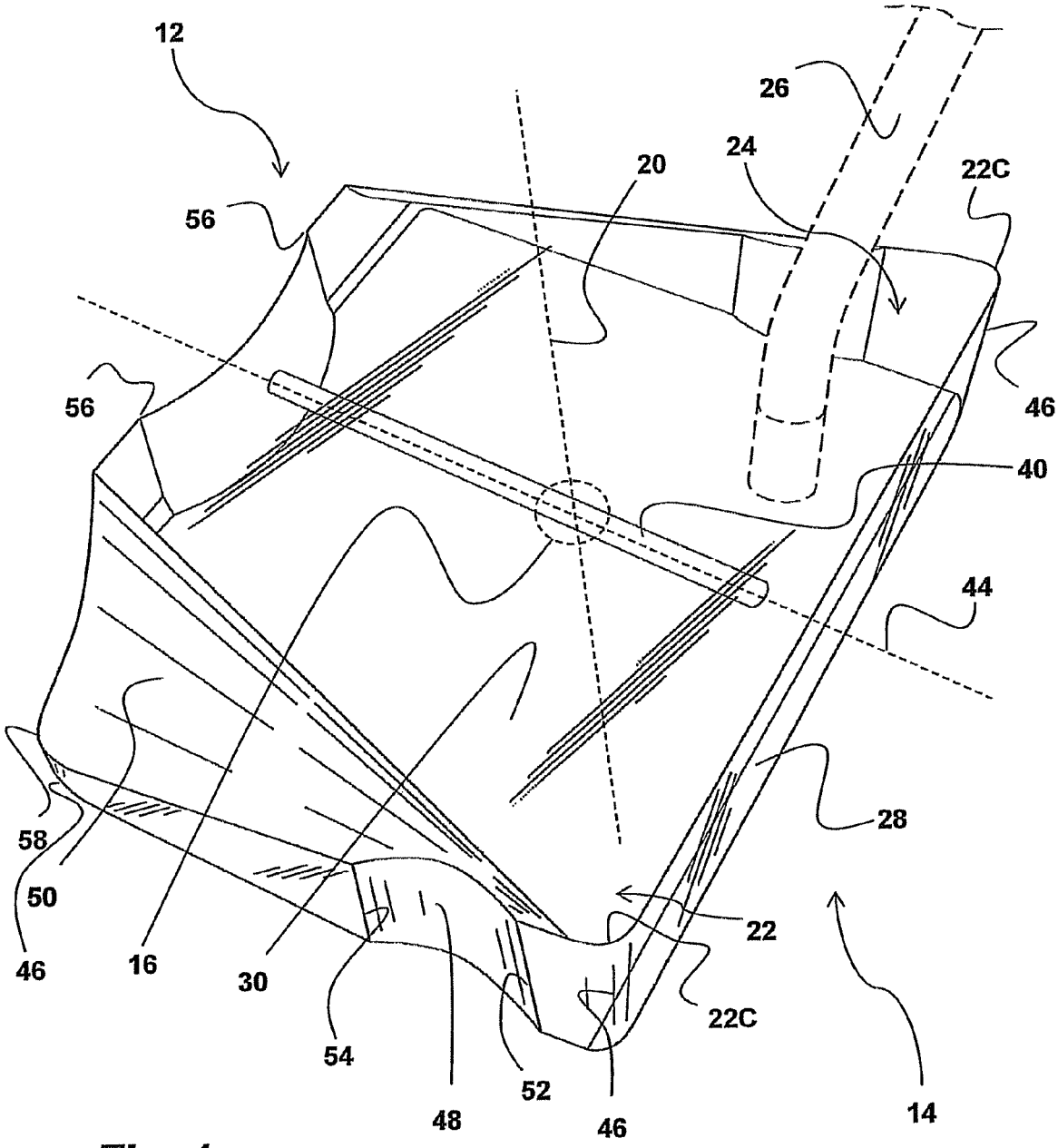
FIG. 1 is a perspective, view of the toe, face and upper surface of an improved golf putter, in accordance with a preferred embodiment of the present invention.

A preferred embodiment of the golf putter 14 is presented in the figures referenced above. In describing the embodiments of the invention, specific terminology will be used for the sake of clarity. However, the invention is not intended to be limited to the specific terms so selected, it being understood that each specific term includes all technical equivalents operating in a similar manner to accomplish a similar purpose. It is understood that the drawings are not drawn exactly to scale. In the drawings, similar reference numbers are used for designating similar elements throughout the several drawings. When a specific drawing, reference number, or element is referred to, it should be understood that the reference is not intended to imply that the referenced matter is not present in other drawings, figures, or embodiments.

This specification and appended claims describe particular embodiments of the invention. However, it should be understood, based on this disclosure, that the invention is not limited to the embodiments detailed herein. As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment of the present disclosure. Thus, the appearances of such phrases in various places throughout this specification are not necessarily all referring to the same embodiment. Furthermore, the particular features, structures, or characteristics may be combined in any suitable manner on one or more embodiments without limitation. The detailed description illustrates by way of example, not by way of limitation, the principles of the invention. This description will clearly enable one skilled in the art to make and use the invention, and describes several embodiments, aspects, adaptations, variations, alternatives, and uses of the invention, including what is presently believed to be the best mode of carrying out the invention.

The examples and illustrations of a putter head and method are described herein with respect to golf putters. However, the inventive concept may be equally applicable for use in other golf clubs. Moreover, while certain materials are discussed herein with respect to various components of the various embodiments, the embodiments are not limited to such materials. For example, in a preferred embodiment, the golf putter head is formed from machined methyl methacrylate and is transparent. However, as will be discussed in more detail below, the device need not by transparent, and other components of the golf putter head may comprise any suitable natural or man-made materials, including metal, glass, or materials formed from a variety of polymers, monomers, and co-polymers, without departing from the scope and spirit of this disclosure.

A golf club head 12, like all other objects, has a center of gravity or center of mass (although there are theoretical differences between "center of gravity" and "center of mass", for purposes of this disclosure, the terms are considered synonymous and interchangeable). An object's center of gravity is the point at which the force of gravity can be considered to act, and, thus, where the weight is concentrated. In the golf putter head 12 of the present invention, the center of gravity is generally indicated at the point 16. On an imaginary line 44 extending outwardly from the center of gravity to the face 28 at the position designated as 18 is a point commonly referred to as the "sweet spot" 18 (FIG. 2), the point at which contact with a golf ball will generally result in the truest shot and at which the putter head 12 will not rotate about a vertical axis of the center of gravity 20 as a result of the impact. A golf ball struck off-center to the sweet spot 18 will tend to cause the putter head 12 to rotate about the vertical axis of the center of gravity 20. Therefore, an impact point between the toe 22 and the sweet spot 18 will generally result in a clockwise rotation of the club head 12 relative to the vertical axis 20 and an impact point between the heel 24 and the sweet spot 18 will generally result in a counter-clockwise rotation of the club head 12.

Moment of inertia is a term used to describe an object's resistance to rotation. The moment of inertia of an object may be calculated with the formula $\Sigma mr^2$. This formula represents the sum ($\Sigma$) of the products obtained from multiplying each elementary mass (m) by the square of the distance from the axis ($r^2$). Thus, the rotational inertia of an object depends not only on its mass, but also on how the mass is distributed with respect to the axis of rotation. A golf club head 12 comprising a higher moment of inertia will tend to resist rotational movement resulting from off center strikes better than a golf club head 12 comprising a lower moment of inertia. The golf putter 14 of the present invention comprises a high moment of inertia and resists rotational movement about the center of gravity vertical axis 20.

Referring to FIGS. 1-10, the putter head 12 of the preferred embodiment comprises concentrations of mass near a heel 24 (FIG. 5) and a toe 22 (FIG. 5) towards a face 28 of the putter head 12 and a wide profile. In a preferred embodiment, the golf putter 14 generally comprises a golf putter head 12 and a shaft 26. The shaft 26 of the preferred embodiment comprises a conventional and commercially available grip mounted on its upper end. In the preferred embodiment, the grip comprises a "jumbo pistol" grip comprising an oversized grip and helping to offset the weight of the club head 12. Although the figures attached and referred to herein depict a "right handed putter" 14, the principles and descriptions herein will apply to a "left handed putters" with the shaft 26 moved from one side to the other, such that the heel side becomes the toe side and the toe side becomes the heel side.

Figure 2:
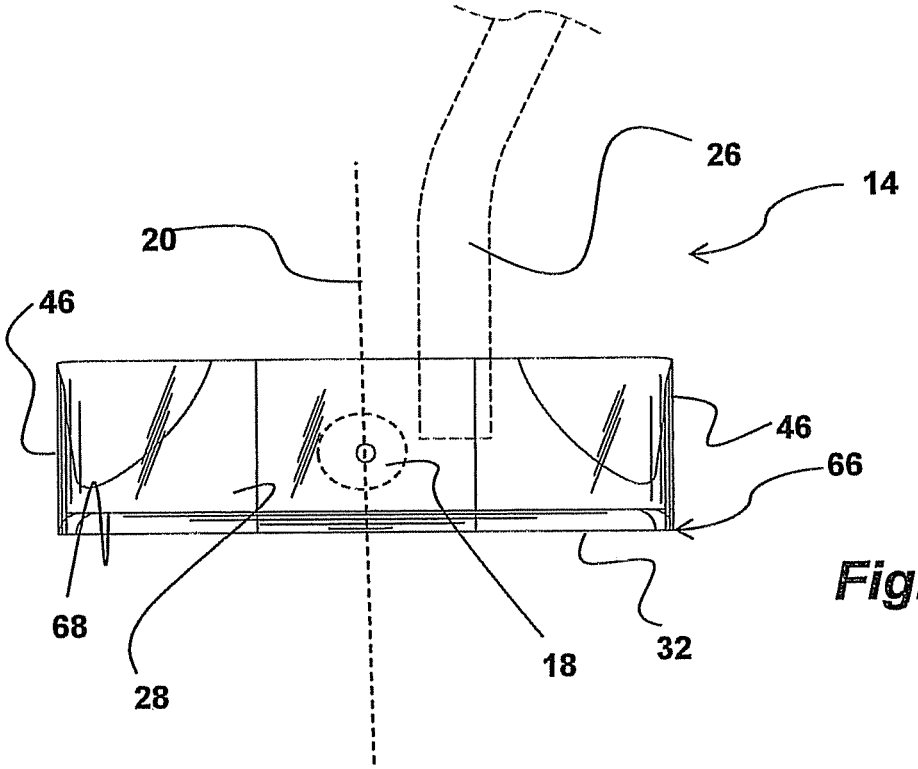
FIG. 2 is a face elevation view of the improved golf putter of FIG. 1.
Figure 3:
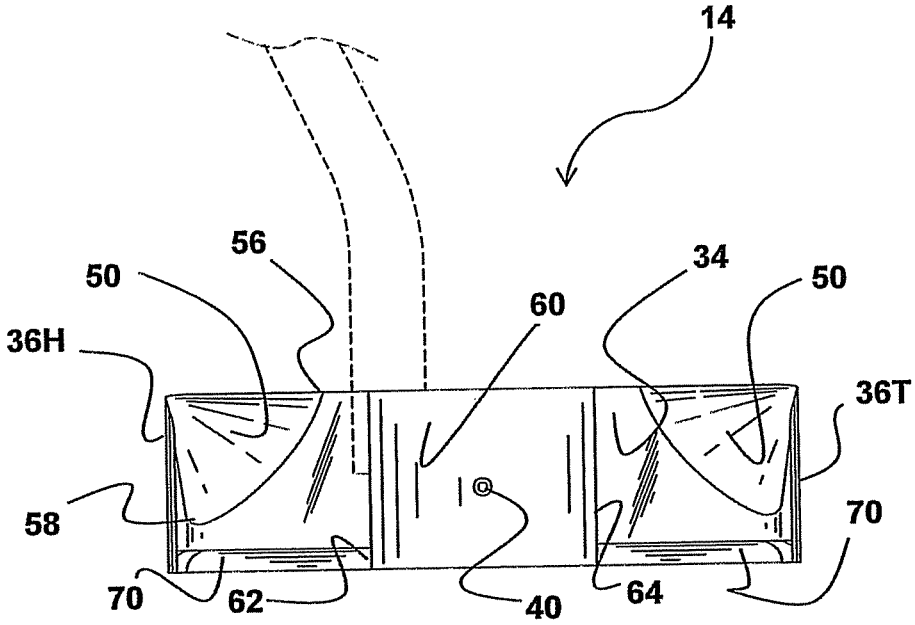
FIG. 3 is a rear elevation view of the golf putter shown in FIGS. 1 and 2.

Referring to FIGS. 1-3, the golf putter head 12 of the preferred embodiment generally comprises the face 28, a toe 22 (FIG. 1), the heel 24 (FIG. 1), an upper surface 30 (FIG. 1), a sole 32 (FIG. 2), a rear surface 34 (FIG. 4), and sides 36H, 36T (FIG. 3) the sides 36H, 36T comprising a heel-side 36H and a toe-side 36T (although the figures attached and referred to herein depict a "right handed putter" 14, the principles and descriptions herein will apply to a "left handed putter" with the shaft 26 moved from one side to the other, such that the heel-side 36H becomes the toe-side 36T and the toe-side 36T becomes the heel-side 36H).

In the preferred embodiment, the overall dimensions of the putter head 12 are 4.5"×3.5"×1.5", such that the face 28 and sole 32 are approximately 4.5"×3.5" and each side 36H, 36T is approximately 3.5"×1.5". Of course, these dimensions may vary. Preferably, a distance between the heel 24 and toe 22 is less than or equal to 7 inches, but greater than a distance from the face 28 to the rear surface 34. In the preferred embodiment, the distance between the heel 24 and toe 22 is 4.5". Preferably, the distance between the heel 24 and toe 22 is greater than or equal to two thirds of the distance from the face 28 to the rear surface 34. In the preferred embodiment, the distance between the heel 24 and toe 22 is approximately 1.29 times the distance from the face 28 to the rear surface 34. Preferably, the distance from the sole 32 to the upper surface 30 is less than or equal to 2.5 inches. In the preferred embodiment, the distance from the sole 32 to the upper surface 30 is 1.5 inches.

The face 28 of the putter head 12 of the preferred embodiment is lofted such that it tilts at an angle. In such a lofted position, the face 28 faces slightly upward. In the preferred embodiment, the face comprises a two degree loft. However, the face 28 need not comprise a two degree loft. Rather, the face 28 may comprise no loft, a negative loft, or a greater than two degree loft without departing from the scope and spirit of the invention. In preferred embodiments, the loft is, preferably, a positive loft ranging between one and three degrees.

The putter head 12 of the preferred embodiment is "face-balanced". As used herein, term face-balanced, shall mean that when a fulcrum (such as a finger) is placed beneath the shaft 26, such that the shaft 26 is balanced on the fulcrum and such that the putter head 12 is permitted to freely assume any position, the face 28 of the putter head 12 faces upward and is generally parallel to the earth's surface (such that, taking into account the loft of the face 28, the face 28 is preferably within 1-3 degrees of parallel to the earth's surface). In the preferred embodiment, the putter head's 12 center of gravity 16 is approximately midway between the toe 22 and the heel 24. Although the putter head 12 of the preferred embodiment is face-balanced, the putter head 12 need not be face-balanced. Rather, the putter-head 12, in other embodiments, may have other balancing configurations such as toe balancing—such that the toe 22 points downward when the fulcrum is placed beneath the shaft 26. In still other embodiments, the putter head 12 may comprise balancing configurations ranging between face-balancing and toe-balancing, as well as heel-balancing.

Figure 6:
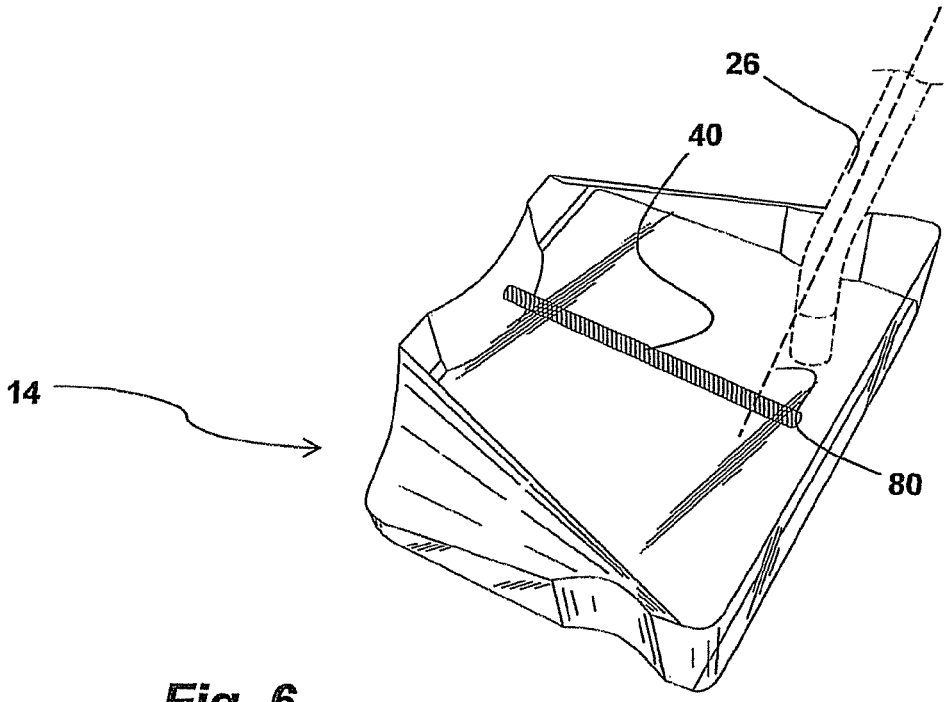
FIG. 6 is a perspective view of the front and upper surface of the improved golf putter, in accordance with another embodiment of the present invention.
Figure 8:
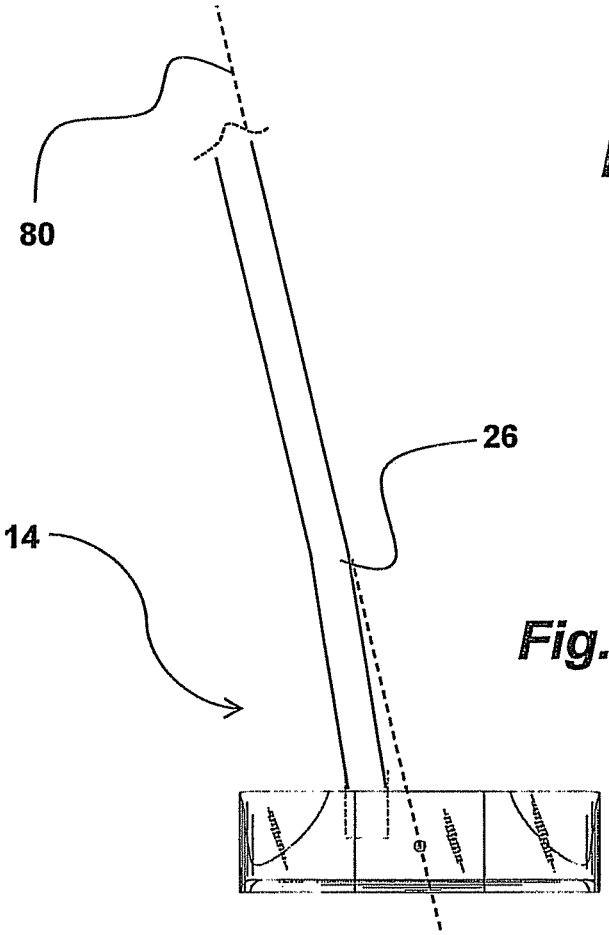
FIG. 8 is a rear elevation view of the golf putter shown in FIG. 7.
Figure 9:
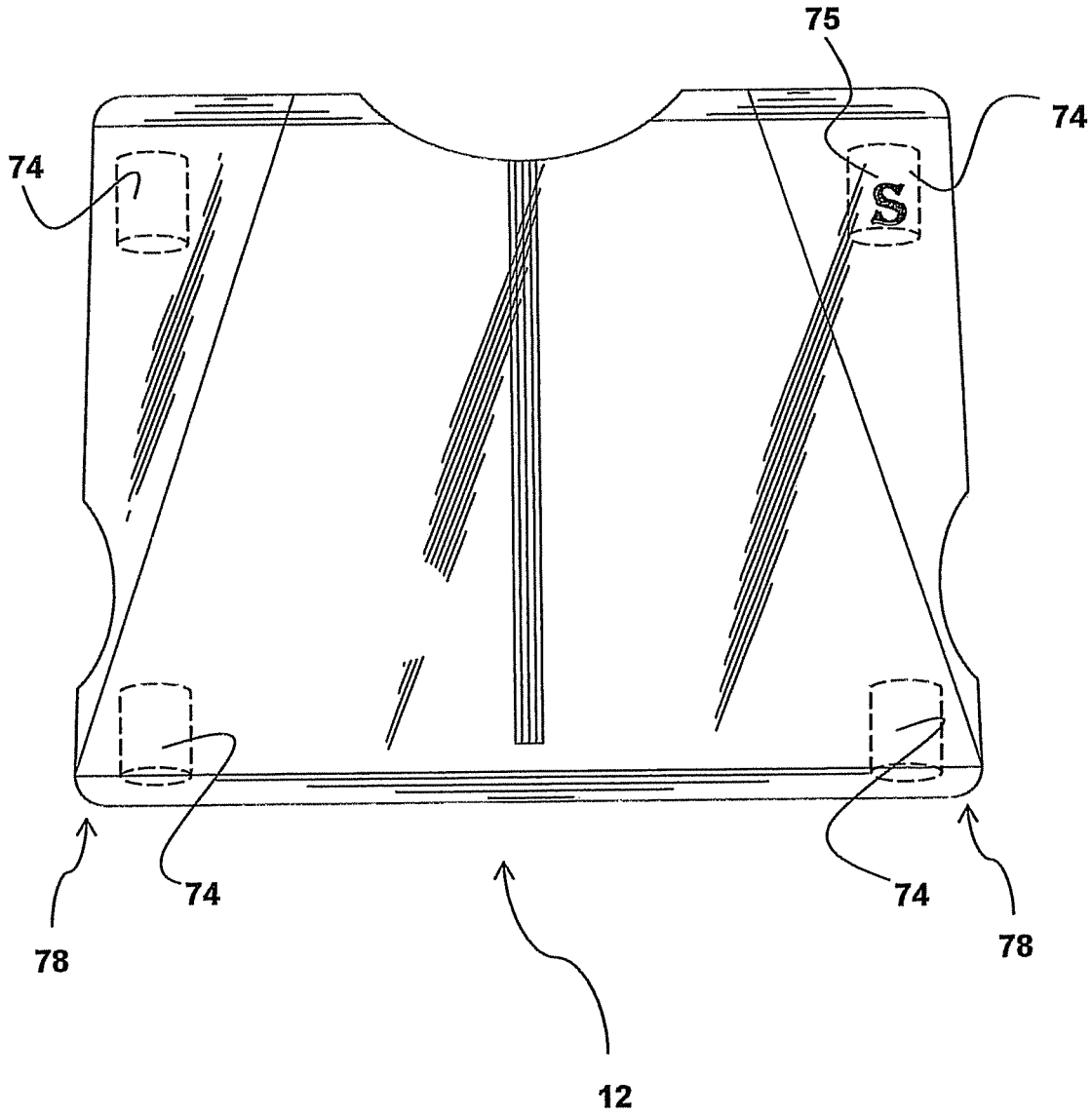
FIG. 9 is a top elevation view of the golf putter, in accordance with another embodiment of the present invention.
Figure 10:
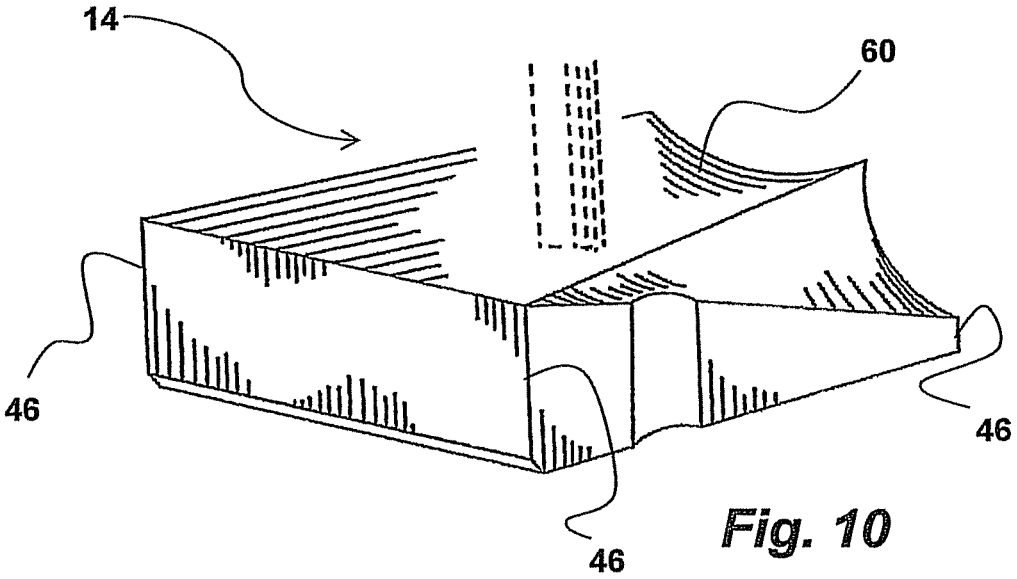
FIG. 10 is a perspective view of the heel, face and upper surface of an improved golf putter, in accordance with another embodiment of the present invention.

Referring to FIGS. 1 & 3, in the approximate center of the putter head 12 and extending from the rear surface 34 towards the face 28, the putter head 12 further comprises a sight member 40. In use, the sight member 40 is centered on the imaginary line 44 bisecting the sweet spot 18 and the center of gravity 16. Ideally, the user should position the putter 14 with the sight member 40 aligned with the target line 44 (FIG. 1). Thus, the horizontal arrangement of the sight member 40 offers the user a visual reference for the preferred area on the face 28 to contact the ball (the sweet spot 18) as well as a visual reference for the target line 44. The sight member 40 of the preferred embodiment comprises a cylindrical length with a cross-sectional diameter of approximately 0.1562 inches and a length of approximately 2.8125 inches. However, the putter 14 need not have a sight member 40 such as in embodiments comprising non-transparent putter heads 12. In non-transparent putter heads 12, a sight member 40 may be placed, engraved, embedded or otherwise positioned proximate to the upper surface 30. Additionally, the sight member 40 can comprise different dimensions and/or configurations. For example, the sight member 40 may be of rectangular, triangular, tubular, or flat material without departing from the scope and spirit of this disclosure. As the putter head 12 of the preferred embodiment is formed from a methyl methacrylate (MMA) polymer and is transparent, the sight member 40 can easily be visualized by the user. In the preferred embodiment, the sight member 40 is of a contrasting color to the color of the putter head 12. In one embodiment, the sight member 40 is white. In another embodiment, the sight member 40 is red. However, the sight member 40 can be virtually any color that can be easily visualized. The sight member 40 color may also be such that the particular model or type of putter is designated. In the preferred embodiment, the sight member 40 is formed by drilling a 5⁄32 inch hole and filling this hole with a mixture of acrylic caulk and latex paint. However, smaller or larger holes may be formed such that the sight member is larger or smaller. Additionally, different materials may be used to create the sight member 40 such as solid or tubular materials. Referring to FIGS. 6 & 8, an axis 80 positioned proximate to the toe-side of the shaft 26 intersects the sight member 40.

The putter head 12, being formed from MMA is more stable, durable, impact and scratch resistant than putter heads 12 formed from other materials, yet, the putter head 12 of the preferred embodiment also comprises a softer face 28 than many other prior art putter heads 12. Another feature important to how consistently a ball reacts to being struck by a putter involves the time the ball remains in contact with the face 28 upon impact, hereafter, "face-to-ball contact time". A ball struck by a putter head 12 face 28 comprising harder materials tends to leave the putter face 28 faster and have a shorter face-to-ball contact time than a ball struck by a putter head 12 face 28 comprising softer materials. The softness of the putter head 12 face 28 of the preferred embodiment promotes an increased face-to-ball contact time. The aforementioned features help ensure that golf balls coming off the putter head 12 face 28 will come off consistently and because the material is both soft and impact/scratch resistant, the putter head 12 will remain soft and unmarred by blemishes, even after prolonged use.

As mentioned, in the preferred embodiment, portions of the putter head 12 are transparent. For example, referring to FIG. 1, the upper surface 30 and sole 32 are transparent such that objects below the sole 32, such as grass, may be seen through the upper surface 30. Other elements of the putter head 12 are more opaque. For example, the angular scalloped portions 50 central scalloped portion 60, and forward scalloped portions 48 are each machined in a way as to cause the respective surface areas to be more opaque (less transparent) than other surfaces. However, such portions 50, 60, 48 need not be more opaque than other surfaces. Rather, such surfaces 50, 60, 48 may be similarly transparent as other surfaces. Although, the golf putter head 12 of the preferred embodiment is transparent and formed from a single piece of solid material, the putter head 12 need not by transparent and formed from a single piece of solid material. Rather, the putter head 12 may be formed from single or multiple pieces of material such as wood, metal, glass, plastic, and the like, and such materials may be opaque and the putter head 12 may be solid, hollow, or hollow with interior reinforcement members.

As best shown in FIGS. 1 & 2, the toe 22 and heel 24 portions comprise rounded portions 46 along the edges at which the face 28 and rear 34 surfaces meet the respective side surfaces 36H, 36T. Such rounded portions 46 provide a clean and contemporary look to the putter 14 while at the same time providing protection against nicks and chips that might result, for example, from placement of the putter 14 within a golf bag, or other extended use of the putter 14. Although the toe 22 and heel 24 portions of the preferred embodiment comprise rounded portions 46, the edges need not comprise rounded portions 46. Rather, referring to FIG. 10, the edges may comprise an orthogonal arrangement such that the respective surfaces 28, 34, 36H, 36T meet at sharp right angles 46. Alternatively, the toe 22 and heel 24 portions may comprise angled or beveled portions along the edges at which the face 28 and rear surface 34 meet the respective side surfaces 36H, 36T.

Each side surface 36H, 36T comprises a forward scalloped portion 48 extending upward from the sole 32. In the preferred embodiment, such forward scalloped portions 48 are approximately 1" wide and at their deepest point, approximately 0.25" deep. Each forward scalloped portion 48 is vertically arranged such that it extends upward from the sole 32 to a position intersected by respective angular scalloped portions 50. A forward edge 52 of each forward scalloped portion 48 is set back from the club face 28 approximately 0.50". A rearward edge 54 is set back from the club face 28 approximately 1.50" (forward of the rear surface 34 approximately 2"). Thus, the width (the distance between the forward 52 and rearward 54 edges) is approximately 1". In a preferred embodiment, each forward scalloped portion 48 comprises an arc approximately correlating with a circle comprising a 3" diameter (1.5" radius). Although the forward scalloped portions 48 are arranged in accordance with the foregoing dimensions and positions in the preferred embodiment, the forward scalloped portions 48 may be positioned differently or comprise, different dimensions. Additionally, there may be more forward scalloped portions 48 than two. For example, additional forward scalloped portions 48 may be positioned towards the rear of the club head 12.

Each side surface 36H, 36T further comprises the angular scalloped portions 50, which, as referenced above, intersect the forward scalloped portions 48. The angular scalloped portions 50 extend at an angle from the rear surface 34 towards the corresponding toe 22 and heel 24. Referring to FIGS. 1 & 3, an upper rear edge 56 of each angular scalloped portion 50 is set in from an outer-most portion of the side face 36 approximately 1.125". A lower rear edge 58 of each angular scalloped portion 50 is set downward from the upper surface 30 approximately 1.125". In a preferred embodiment, each angular scalloped portion 50 comprises an arc approximately correlating with a circle comprising a 2" diameter (1." radius). As the angular portions 50 angle away from the rear surface 34 towards respective forward toe and heel corners 22C, 24C (FIG. 1), the angular scalloped portions 50 are wider near the rear surface 34 than proximate to the face 28. When viewed from the top (FIGS. 4 & 5), the angular scalloped portions 50 extend from the rear surface 34 towards the face 28 at approximately a 72 degree angle. Although each side surface 36H, 36T of the preferred embodiment comprises the angular scalloped portions 50 arranged in accordance with the foregoing dimensions and positions, the angular scalloped portions 50 may be positioned differently or comprise different dimensions. Additionally, there may be no angular scalloped portions 50. For example, as mentioned, additional forward scalloped portions 48 may be positioned towards the rear of the club head 12 replacing, or augmenting the angular scalloped portions 50.

Figure 4:
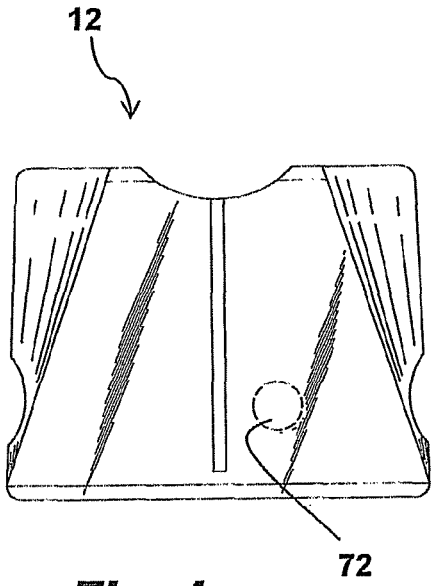
FIG. 4 is a perspective view of the front and upper surface of the improved golf putter, in accordance with a preferred embodiment of the present invention.
Figure 5:
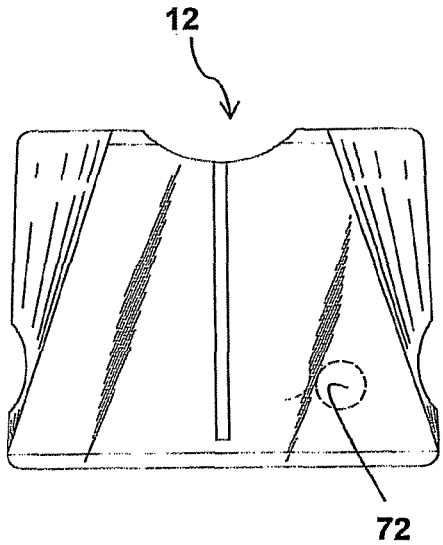
FIG. 5 is a perspective view of the front and upper surface of the improved golf putter, in accordance with another embodiment of the present invention.

The rear surface 34 comprises a central scalloped portion 60 extending upward from the sole 32 to the upper surface 30. In the preferred embodiment, such central scalloped portion 60 is approximately 1.75" wide and at its deepest point, approximately 0.3125" deep. In a preferred embodiment, this central scallop comprises an arc approximately correlating with a circle comprising a 3" diameter (1.5" radius). The central scalloped portion 60 is vertically arranged such that it extends upward from the sole 32 to the upper surface 30. Referring to FIG. 4, a heel-side edge 62 of the central scalloped portion 60 is set inward from the heel-side 36H approximately 1.375". A toe-side edge 64 of the central scalloped portion 60 is set inward from the toe-side 36T approximately 1.375". Thus, the width (the distance between the heel-side and toe-side edges 62, 64) is approximately 1.75". Although the central scalloped portion 60 is arranged in accordance with the foregoing dimensions and position in the preferred embodiment, the central scalloped portion 60 may be positioned differently or comprise different dimensions. For example, the central scalloped portion 60 may be angled inward and toward the face and upper surface 30 such as that shown in FIG. 10.

In the preferred embodiment, the lower edge 66 (FIG. 2), at which the face 28 and sole 32 meet, comprises a forward bevel 68. Among other benefits, this forward bevel 68 helps prevent the club face 28 from "catching" or "snagging" a putting surface during forward strokes. In the preferred embodiment, with respect to the face 28, the forward bevel 68 begins approximately 0.375" from the sole 32, and with respect to the sole 32, approximately 0.375" from the face 28. Thus, the forward bevel 68 extends at approximately a 45° from both surfaces 28, 32.

Referring to FIG. 3, the portions of the rear surface 34 on either side of the central scalloped portion 60 comprise rearward bevels 70 at a position at which such rear surface 34 portions meet the sole 32. These rearward bevels 70, among other benefits, also help prevent the club face 28 from catching or becoming snagged by the putting surface during take-away strokes. In the preferred embodiment, with respect to the rear surface 34, the rearward bevels 70 begin approximately 0.375" from the sole 32, and with respect to the sole 32, approximately 0.375" from the rear surface 34. Thus, the rearward bevels 70 extend at approximately a 45° from both surfaces 32, 34.

The putter head 12 of the preferred embodiment, comprises concentrations of mass near the heel 24 (FIG. 1) and the toe 22 (FIG. 1) towards the face 28 and a wide profile. Thus, the area proximate to the face 28 comprises more mass that the area proximate to the rear surface 34. This forward concentration of mass correlates with a forward center of gravity 16.

Additionally, while conventional putters sometimes only comprise one or two inches between the face 28 and rear surface 34, the putter head 12 of the preferred embodiment comprises 3.5" between the face 28 and the rear surface 34. Likewise, the putter head 12 of the preferred embodiment comprises a wide face 28. In the preferred embodiment the face 28 is 4.5" wide. This width further increases the moment of inertia of the putter head 12. Additionally, the putter head 12 of the preferred embodiment comprises a wide distance between the sole 32 and the upper surface 30. The putter head 12 of the preferred embodiment comprises 1.5" between the sole 32 and the upper surface 30. This distance further increases the moment of inertia of the putter head 12. Traditional putters, for example, only comprise a 1" distance between the sole 32 and the upper surface 30 and a center of gravity 16 positioned approximately half-way between these surfaces 32, 30, or 0.5" above the sole 32. A typical golf ball has a diameter of between 1.62" and 1.68" and a center of gravity between 0.81" and 0.84". Thus, most putters have a center of gravity 16 well below the center of gravity of the golf ball. In contrast, the putter head 12 of the preferred embodiment comprises a center of gravity 16 approximately 0.75" above the sole 32—approximately ¼" higher than other putters. This higher center of gravity 16 of the putter head 12 of the preferred embodiment promotes a ball strike at a position above an equator of the ball. Striking the ball further above the equator promotes more top spin, which, in turn, promotes more consistent ball roll.

In other embodiments, one or more weight members 74 may be disposed in various positions on or within the club head 12. For example, weight members 74 may be positioned near the forward corners 22C, 24C. Weight members 74 may be positioned near the rearward corners 78. The weight members 74 may be formed from high density material such as lead, steel, metal, a liquid, or of material otherwise comprising a density greater than that of the club head 12, such as glass, and can be of various configurations such as disc, cylinder, cube, rectangular, circular, and/or orb shaped. Such weight members 74 will further increase the moment of inertia of the putter head 12. Additionally, weight members 74 (or other portions of the putter head 12, shaft 26, or grip) may comprise an engraved, etched, holographic, logo, or other image 79.

Referring to FIG. 4, the upper surface 30 further comprises a canal 72 adapted for insertion of the shaft 26. The position of the canal 72 may vary depending on the particular embodiment. In a preferred embodiment, the canal 72 is centered approximately ¾" away from the sight member 40 towards the heel-side 36H of the putter head 12 and approximately ⅞" away from the face 28. In other embodiments, the canal 72 is centered approximately 1" away from the sight member 40 towards the heel-side 36H of the putter head 12 and approximately ½" away from the face 28. Although in the preferred embodiment, the canal 72 is vertical such that it extends into the club head 12 perpendicular to the upper surface 30, the canal 78 need not be vertical. Rather, the canal may be angled in virtually any direction in order to accommodate shafts 26 entering the club head 12 at different angles.

Figure 7:
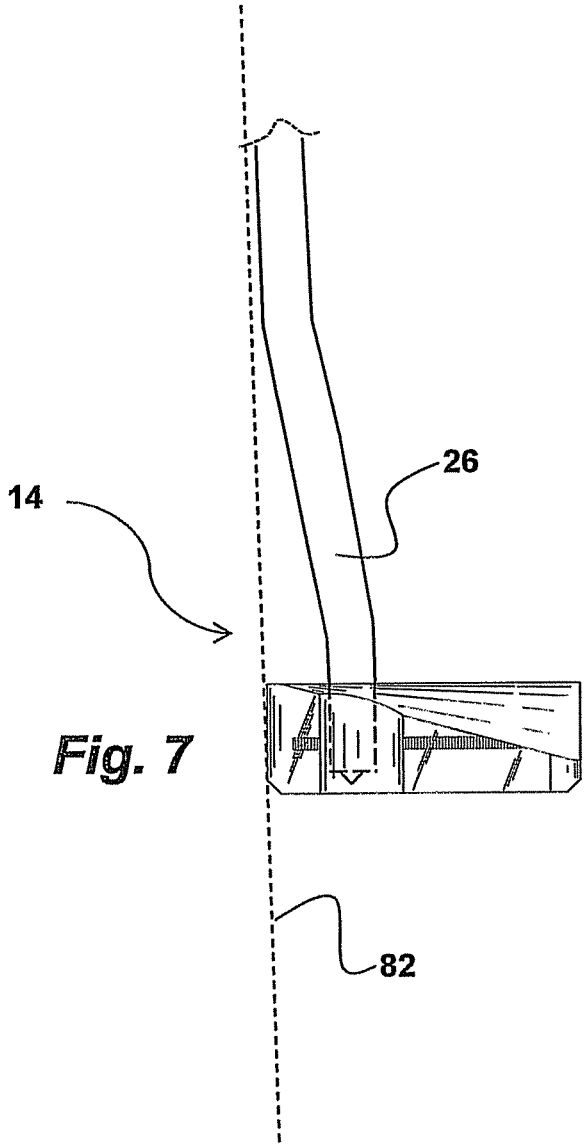
FIG. 7 is a side-heel elevation view of the improved golf putter with a complex shaft arrangement, in accordance with another embodiment of the present invention.

A lower end of the putter shaft 26 is positioned and affixed within the canal 72. In different embodiments, and as shown in FIGS. 2-6, the shaft 26 may comprise different configurations. In one embodiment, the shaft 26, vertically positioned within the canal 72, bends at approximately a 20° angle towards and beyond the heel-side 36H, the bend beginning approximately 1" above the upper surface 30. In another embodiment, the shaft 26 comprises a complex bending arrangement such that the shaft 26, vertically positioned within the canal 72, beginning at the upper surface 30, bends forward and towards the heel-side 36H, and at approximately 2.5" inches above the upper surface 30, bends at approximately a 20° angle towards and beyond the heel-side 36H. Referring to FIG. 7, in this embodiment, the shaft 26 extends upward parallel to a plane extending upward from the sole 32 proximate to the surface of the face 28. Although the shafts 26 are arranged in accordance with the foregoing positions with the described bending arrangements and configurations in the described embodiments, the shafts 26 may be positioned differently or comprise different bending arrangements and configurations.

In a preferred embodiment, the shaft 26 comprises a multi-segment steel shaft 26 comprising a plurality of segments comprising different diameters. In a preferred embodiment, the shaft 26 comprises twelve segments ranging in diameter size from approximately 9.4 mm near the upper surface 30 to approximately 15.1 mm at the grip end. In the preferred embodiment, the shaft 26 measures 35 inches from end to end. However, the shaft may be virtually any desirable length.

The foregoing disclosure and showings made in the drawing are merely illustrative of the principles of this invention and are not to be interpreted in a limiting sense. While the invention is shown in only a few forms, it is not just limited to the forms shown, but is susceptible to various changes and modifications without departing from the spirit thereof. The foregoing description of a preferred embodiment of the invention has been presented for the purpose of illustration and description. It is not intended to be exhaustive or to limit the invention to the precise form disclosed. Obvious modifications or variations are possible in light of the above teachings. The invention may be adapted for use in a number of environments.

The embodiments were chosen and described to provide the best illustrations of the principles of the invention and its practical application, and to enable one of ordinary skill in the art to utilize the invention in various embodiments and with various modifications as are suited to the particular use contemplated. All such modifications and variations are within the scope of the invention in accordance with the breadth of this disclosure and appended claims, to which they are fairly, legally, and equitably entitled to be interpreted.

I claim:

1. A golf putter head comprising:

a face, an upper surface, a sole, a rear surface, and sides, said sides comprising a heel-side, and a toe-side;

the heel-side comprising a heel-side forward scalloped portion and the toe-side comprising a toe-side forward scalloped portion, said heel-side and toe-side forward scalloped portions each extending upward from the sole;

the heel-side further comprising a heel-side angular scalloped portion and the toe-side further comprising a toe-side angular scalloped portion, said heel-side angular scalloped portion extending at an angle from the rear surface towards a forward heel corner, said toe-side angular scalloped portion extending at an angle from the rear surface towards a forward toe corner; and the golf putter head being face-balanced.

2. The golf putter head of claim 1, the rear surface comprising a central scalloped portion, said central scalloped portion being positioned approximately midway between said heel-side and toe-side and extending upward from the sole to the upper surface.

3. The golf putter head of claim 1, being at least partially transparent.

4. The golf putter head of claim 3, further comprising a sight member, the sight member being centered on an imaginary line bisecting the approximate center of the face and a golf putter head center of gravity.

5. The golf putter head of claim 4, the sight member being of a contrasting color to a putter head color.

6. The golf putter head of claim 5, the sight member being cylindrical.

7. The golf putter head of claim 1, comprising a plurality of edges, one or more of said plurality of edges being rounded.

8. The golf putter head of claim 1, comprising a plurality of edges, one or more of said plurality of edges being beveled.

9. The golf putter head of claim 8, wherein a lower forward edge is beveled.

10. The golf putter head of claim 8, wherein a lower rearward edge is beveled.

11. The golf putter head of claim 1, the putter head comprising a forward center of gravity relative to the face.

12. The golf putter head of claim 1, the upper surface comprising a canal adapted for insertion of a portion of a shaft.

13. The golf putter head of claim 12, said portion of said shaft being positioned within the canal.

14. The golf putter head of claim 13, said canal being positioned towards the heel-side and away from the face.

15. The golf putter head of claim 14, said shaft being configured such that it is bent at an angle towards and beyond the heel-side.

16. The golf putter head of claim 14, said shaft being configured such that, at a position proximate to the upper surface, the shaft is bent forward and towards the heel-side, and, at a more distal position from the upper surface, said shaft being bent at an angle towards and beyond the heel-side.

* * * * *